US008201702B2

(12) United States Patent
Harleman

(10) Patent No.: US 8,201,702 B2
(45) Date of Patent: Jun. 19, 2012

(54) FOLDABLE RECYCLING APPARATUS

(75) Inventor: David P. Harleman, Vinita Park, MO (US)

(73) Assignee: Harleman Products, LLC, Saint Louis, MO (US)

( * ) Notice: Subject to any disclaimer, the term of this patent is extended or adjusted under 35 U.S.C. 154(b) by 691 days.

(21) Appl. No.: 12/035,739

(22) Filed: Feb. 22, 2008

(65) Prior Publication Data

US 2009/0127257 A1 May 21, 2009

Related U.S. Application Data

(60) Provisional application No. 61/003,281, filed on Nov. 16, 2007.

(51) Int. Cl.
*B65D 30/10* (2006.01)

(52) U.S. Cl. ..... 220/9.3; 206/223; 206/546; 206/549; 206/575; 206/577; 220/4.28; 220/4.29; 220/4.31; 220/4.32; 220/4.33; 220/7; 220/8; 220/9.1; 220/908; 383/33; 383/38; 248/95; 248/97; 248/99; 248/100; 248/166

(58) Field of Classification Search ..... 206/577, 206/223, 546, 549, 575; 220/9.3, 4.28, 4.29, 220/4.31, 4.32, 4.33, 4.34, 7, 8, 9.1, 908; 383/33, 38; 248/95, 99, 100, 97, 166
See application file for complete search history.

(56) References Cited

U.S. PATENT DOCUMENTS

| | | | | |
|---|---|---|---|---|
| 608,442 | A * | 8/1898 | Cronmiller | 248/166 |
| 2,255,845 | A * | 9/1941 | Goldwyn | 112/424 |
| 4,646,802 | A * | 3/1987 | Basore et al. | 220/9.4 |
| 5,234,116 | A * | 8/1993 | Kristinsson et al. | 211/201 |
| 5,885,002 | A * | 3/1999 | Reiss | 383/37 |

* cited by examiner

*Primary Examiner* — Anthony Stashick
*Assistant Examiner* — Elizabeth Volz
(74) *Attorney, Agent, or Firm* — Joseph E. Zahner

(57) ABSTRACT

The invention provides a modular and foldable recycling apparatus for home use. The apparatus contains multiple modules attached in series, which can be separated into individual modules. Each module is made of a foldable frame to hold a container, such as a bag, for the containment, separation and transport of recyclable materials. The apparatus can be folded like an accordion to allow for convenient storage.

4 Claims, 5 Drawing Sheets

FOLDABLE RECYCLING APPARATUS

PARENT CASE TEXT

This application claims the benefit of U.S. Provisional Patent Application No. 61/003,281 which was filed on Nov. 16, 2007.

BACKGROUND

The invention is generally directed to portable containers and specifically directed to foldable recycling containers for use in the home.

Recycling has become an important part of reducing the environmental footprint of people. More and more, people, municipalities and other localities have programs directed to recycling common household waste. This creates the problem of sorting, storing and transporting recyclable materials in the home. There is a need for useful, flexible, and architecturally pleasing recycling stations or bins for use in the home.

SUMMARY

In one aspect, the invention provides a foldable recycling apparatus comprising a foldable frame and a plurality of flexible containers for holding materials.

In some embodiments, the foldable frame comprises articulated struts and dowels to allow for accordion-like folding. The struts and dowels may be made of any stiff material, for example metal, plastic, carbon fiber, or cellulosic material.

In some embodiments, the flexible containers comprise flexible materials, such as burlap or plastic sheeting. In one embodiment, the flexible container is a burlap or other natural fiber bag.

In some embodiments, the apparatus comprises 2, 3, 4, 5, 6 or more modules, wherein each module comprises a container fastened to a modular foldable frame, and wherein each module is attached to one or two other modules in series. In some embodiments, the modules are separable into one or more single modules. each modular frame is connected to one or two other modular frames. In one embodiment, the apparatus comprises 3 modules connectable in series.

DETAILED DESCRIPTION OF AN EMBODIMENT OF THE INVENTION

Figure 1:
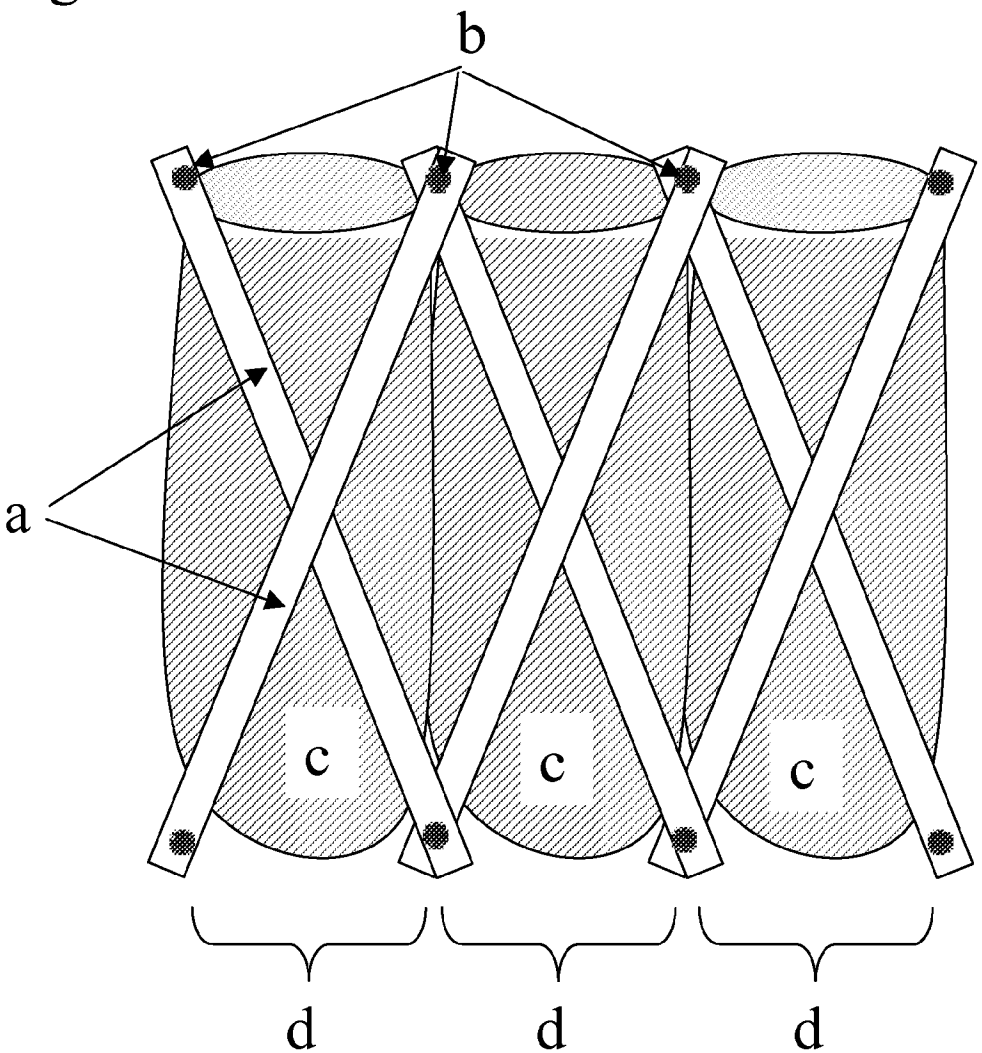
FIG. 1 depicts a front view of an expanded three container apparatus.
Figure 2:
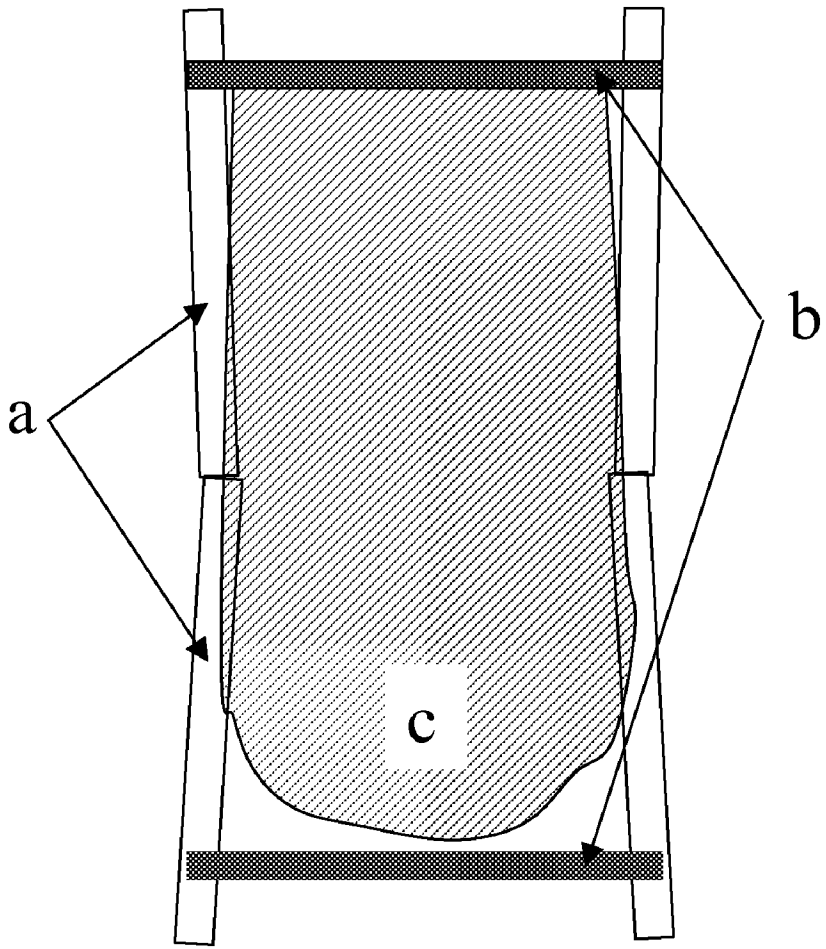
FIG. 2 depicts a side view of an expanded three container apparatus.

The invention provides a foldable recycling apparatus, which comprises a foldable modular frame and a plurality of containers for sorting, storing and/or transporting trash or recyclable materials. Described is an apparatus that accommodates three containers. However, it is understood that the apparatus may accommodate as few as two containers, with no upper limit. The foldable frame, being modular, can be expanded to accommodate additional modules. As used herein, the term "module" means a portion of the frame of the apparatus that accommodates a single container.

The foldable modular frame comprises struts that are interconnected in an articulating fashion to enable folding via rotation at the joints between struts. A joint comprise a dowel, which can serve as an articulated hinge and as a supporting structure for attaching a container. The foldable modular frame can be expanded to accommodate a fully expanded container, and it can be folded to decrease the foot-print of the apparatus and to enable storing of the apparatus in a smaller space. The struts may be made from any material that is essentially inflexible along the short axis and semi-flexible to inflexible along the long axis. Thus, the struts may be made from material such as but not limited to cellulose fiber, such as e.g. wood, recycled laminate wood, bamboo, wicker, et cetera, plastic, metal, such as e.g. aluminum, steel, titanium, alloys, et cetera, glass, fiberglass, carbon fibers, ceramic, and composite material.

Each container of the plurality of containers is seated within an individual module of the frame. Each container can be removed from its module to enable, inter alia, the transportation of the contents of the container, the washing of the container, and/or replacement of the container. In some embodiments, the container is flexible and can be a sack, such as a burlap bag. Thus, the container can be made of any flexible material, such as, but not limited to plastic, cloth, and the like. A preferred material is a durable natural material, such as canvas or burlap.

In yet another embodiment, the modules are separable into individual "stand alone" units. For example, for an apparatus comprising 3 modules attached in series, the apparatus can be subdivided into 3 individual modules or 1 individual module and one duplex consisting of 2 attached modules.

In yet another embodiment, the invention provides a kit comprising struts, dowels and instructions for assembling the apparatus in a box. Optionally, the kit comprises containers. Preferred containers are bags made from a durable natural material, such as e.g. burlap.

While the inventor envisions that the apparatus is useful as a recycling apparatus for in-home use, the end-user would readily recognize that the invention has many other uses and can accommodate any material. For example, the apparatus can be used, inter alia, to store clothing, sports equipment, food, et cetera. The apparatus is not limited by size, and may be sized for use in a kitchen, garage, truck bed, garden, tool shed, automobile, and/or the like. In one preferred embodiment, the apparatus is of a size to fit within a kitchen or utility room, having the overall and non-limiting dimensions for a single module and container of, e.g., approximately 3 ft tall by 1 to 2 feet wide.

Figure 3:
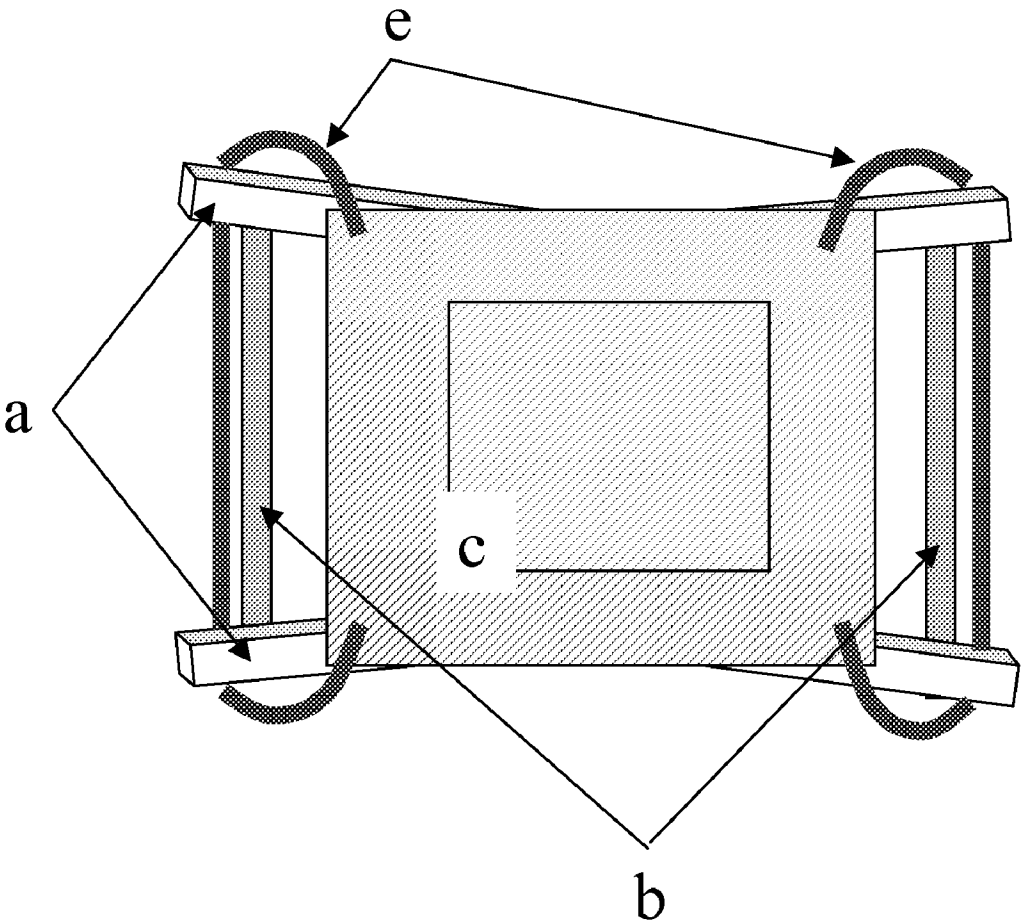
FIG. 3 depicts a top view of an expanded single module.
Figure 4:
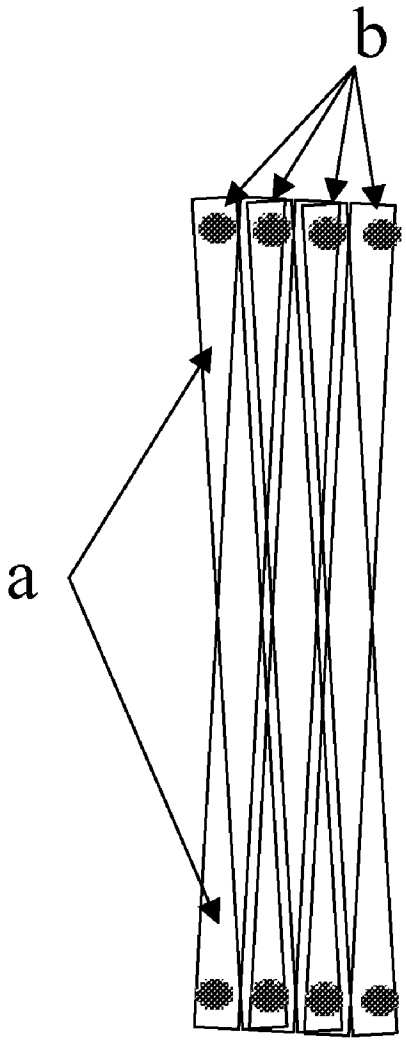
FIG. 4 depicts a front view of a folded three container apparatus.

FIGS. 1-5 depict a particular preferred embodiment of the invention. The following description makes reference to the figures. Each frame of a module (d) comprises four (4) struts (a) and four (4) dowels (b). Dowels are positioned at the top and bottom of each strut, the long axis of each dowel running perpendicular to the long axis of each strut. Each end of each dowel is fixed to the end of at least two different struts. In some embodiments, a dowel can be fixed to the end of a strut by being inserted into a hole in the strut and fixed with a cotter pin. The dowel can freely rotate at the point of insertion in the strut, to allow for the folding of the apparatus as shown in FIG. 4. At the front face and back face of the apparatus, the struts are arranged in a crosswise manner to accommodate folding. At the joint between any two (2) adjacent modules (d), each end of each dowel inserts into the ends of two (2) overlapping struts (see for example FIG. 1 for expanded apparatus and FIG. 4 for folded apparatus).

Figure 5:
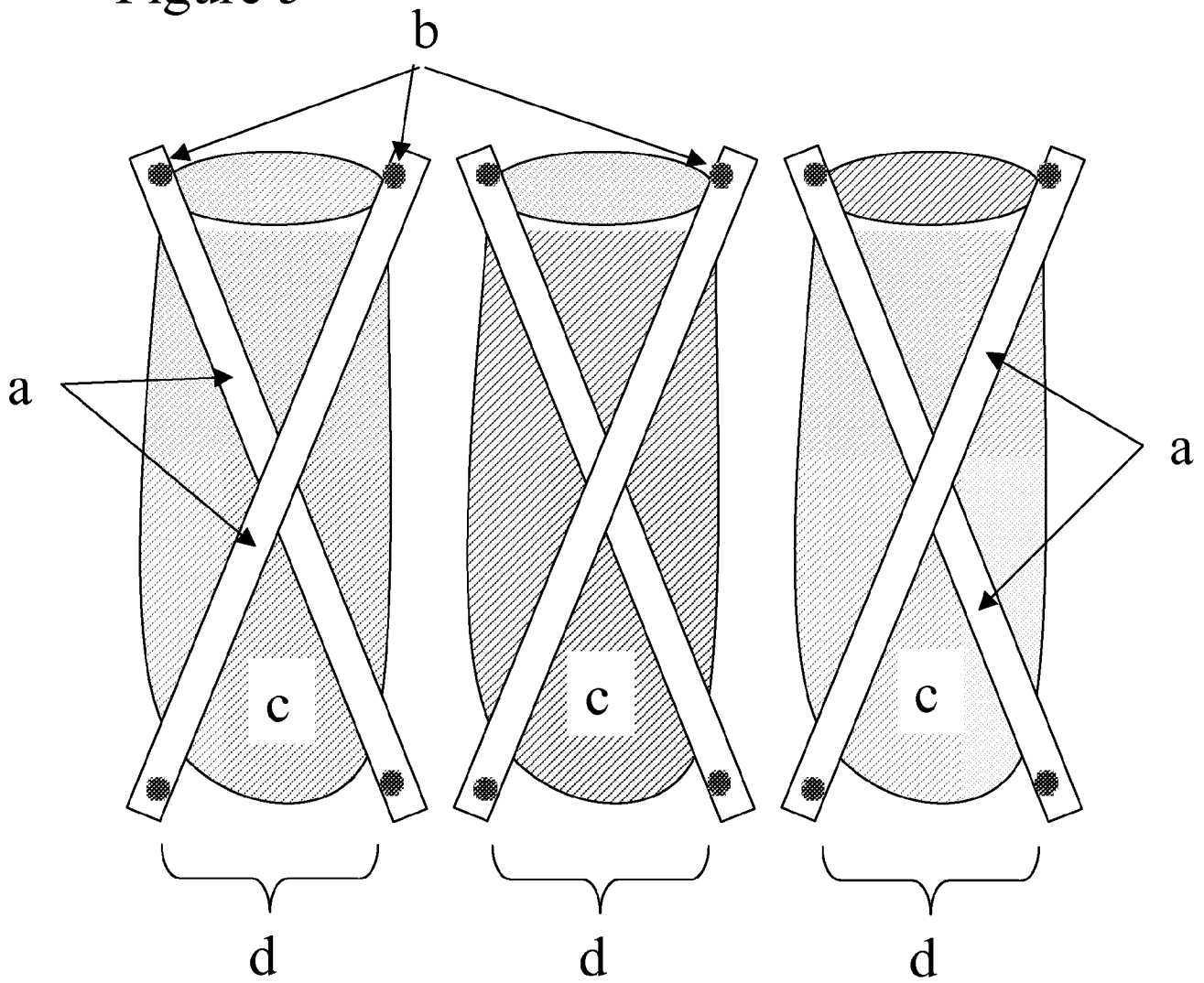
FIG. 5 depicts a front view of an expanded three container apparatus separated into three individual units.

Modules (d) can be separated by removing the top and bottom dowels at the joint between two (2) adjacent modules. Additional dowels are inserted at the new end of the single module to maintain the integrity of the single module frame (FIG. 5).

A container (c), such as a burlap bag, can be hung onto the frame by a hanging means, such as a strap (e), as shown in the top down view of FIG. 3.

The foregoing disclosure is providing by way of example and is not meant to limit the invention. The skilled artisan, in the practice of the invention would readily recognize other embodiments without departing from the spirit and scope of the invention, which is provided in the claims that follow.

I claim:

1. A kit consisting of 12 struts, eight dowels, three bags, and instructions for assembling a recycling station consisting of three modules, in a box.

2. The kit of claim 1, wherein the bags are burlap bags.

3. The kit of claim 2, wherein each strut comprises a hole at each end, wherein said hole accommodates a dowel.

4. The kit of claim 3, wherein each strut and each dowel is wooden.

* * * * *